United States Patent [19]

Cyr

[11] Patent Number: 4,610,286

[45] Date of Patent: Sep. 9, 1986

[54] CAMERA BAG WITH COMPENSATION FOR VARIABLE CAMERA-SUPPORT DISTANCE BELOW LENS, AND WITH IMPROVED ACCESS

[75] Inventor: Jesselyn T. Cyr, Tarzana, Calif.

[73] Assignee: Tamrac, Inc., Van Nuys, Calif.

[21] Appl. No.: 794,337

[22] Filed: Nov. 4, 1985

Related U.S. Application Data

[63] Continuation of Ser. No. 585,895, Mar. 2, 1984, abandoned, which is a continuation-in-part of Ser. No. 378,427, May 14, 1982, abandoned.

[51] Int. Cl.[4] ..... A45C 11/38; B65D 30/22

[52] U.S. Cl. ..... 150/52 J; 190/110; 206/316; 206/587

[58] Field of Search ..... 150/52 J; 206/316, 587; 190/109, 110; 224/901

[56] References Cited

U.S. PATENT DOCUMENTS

| | | | |
|---|---|---|---|
| 2,290,307 | 7/1942 | Wicker | 150/52 J |
| 2,298,144 | 10/1942 | McNabb | 150/52 J |
| 2,314,491 | 3/1943 | Greenberg | 206/587 X |
| 3,306,405 | 2/1967 | Rosenblum | 190/110 |
| 3,491,909 | 1/1970 | Ikelheimer | 190/109 X |
| 3,780,487 | 12/1973 | Munson | 206/587 X |
| 4,210,186 | 7/1980 | Belenson | 150/52 J |
| 4,212,377 | 7/1980 | Weinreb | 150/52 J X |
| 4,260,004 | 4/1981 | Domke | 150/52 J X |
| 4,330,073 | 5/1982 | Clark | 150/52 J X |

FOREIGN PATENT DOCUMENTS

| | | | |
|---|---|---|---|
| 2447694 | 8/1980 | France | 190/109 |
| 961639 | 6/1964 | United Kingdom | 150/52 J |

*Primary Examiner*—William Price
*Assistant Examiner*—Sue A. Weaver
*Attorney, Agent, or Firm*—Romney Golant Martin Seldon & Ashen

[57] ABSTRACT

A case for holding equipment such as cameras and accessories has a shell formed of a bottom wall and upstanding sidewalls and end walls. Dividers, which extend between the sidewalls, are secured to the sidewalls in an adjustable fashion that allows them to be positioned horizontally to divide the case into compartments of different sizes. A horizontal support extends between, is attached to the sidewalls and is secured to the end wall and one of the dividers for providing a horizontal surface for supporting the bottom of a camera body. The dividers have U-shaped cutouts that support a lens attached to and extending out from the camera body. The horizontal support is adjustable vertically to accommodate different sized camera bodies so that the horizontal support and the U-shaped cutouts in the dividers cooperate to support the camera body and its attached lens above the rest of the accessories and extra lenses in the case. This provides quick access without displacing the space required for extra lenses and accessories.

25 Claims, 6 Drawing Figures

CAMERA BAG WITH COMPENSATION FOR VARIABLE CAMERA-SUPPORT DISTANCE BELOW LENS, AND WITH IMPROVED ACCESS

RELATED APPLICATION

This is a continuation of co-pending application Ser. No. 585,895 filed on Mar. 2, 1984, and now abandoned, which was itself a continuation-in-part of Application Ser. No. 378,427, filed May 14, 1982 and now abandoned.

BACKGROUND OF THE INVENTION

1. Field of Invention

This invention relates to a case for storing and carrying equipment such as cameras, parts and accessories or other similar items.

2. Description of the Prior Art

Professional and amateur photographers often carry and store many different photographic items for taking pictures in different circumstances. Cameras utilize interchangeable lenses, and many photographers want such lenses organized in a case available for quick changing. Two or more camera bodies may be carried, which the photographer may load with different films so that he can switch cameras as conditions change. For example, a sports photographer may carry two 35 mm camera bodies, loading one with high speed black and white film for newspaper photographs and the other with color or slower film for magazine pictures. The photographer may need different telephoto lenses, a normal lens and wide angle lenses and may also carry one or more light meters, different types of flash attachments, filters and extenders.

In normal use, it is desirable to keep these items organized and protected. This organization may be crucial in certain situations where the photographer must change lenses rapidly without having to reach under unneeded items. It is also essential to provide sufficient protection to photographic equipment. Cameras are precision equipment that sudden shocks can damage. Lenses can be scratched and jarred out of alignment if not properly cared for.

One solution is to have separate cases for each piece of equipment. Cameras are often mounted in relatively hard cases to protect them (e.g., McNabb, U.S. Pat. No. 2,298,144 (1942), and hard or padded cylindrical lens cases of varying sizes are sold in order to protect each lens (e.g., Clark, U.S. Pat. No. 4,330,073 (1982)). Using separate cases, however, slows lens, body and film changes. It is more time consuming to open a main case, which holds all of the photographer's equipment, locate an intermediate lens case and hard camera case and to open both than it is to open a single case and remove the lens and camera body. The hard, separate cases provide good protection for photographic equipment because they are normally sized to fit a particular piece of equipment. Lens cases, for example, come in different lengths and diameters so that the lens will not be damaged by movement within the lens case. Camera cases are usually meant to store the camera body only if a no larger than normal lens is mounted on the body. Most cannot be used with a telephoto or other large lens mounted on the body. Also, the cases normally do not accommodate electric winders, and the camera cases must usually be removed when changing film.

In response to the need for better cases, a number of systems have entered the market. One is a rigid case with a foam insert having cutouts to accommodate various pieces of equipment. These systems provide excellent protection for the equipment, but they offer little flexibility. Once the foam is cut to accommodate specific accessories, the case cannot be modified easily.

To meet the need for greater flexibility, convertible cases have developed. Two such cases are Weinreb, U.S. Pat. No. 4,212,377 (1980) and Hamamm, U.K. Pat. No. 961,639 (1964). Present convertible cases are normally soft sided and covered in fabric. The bottom may be hard to maintain the shape of the case, and the walls are frequently padded. The interior of such cases may be divided by means of internal dividers. These dividers usually rest on the bottom wall and are connected to the sidewalls by Velcro fasteners or other fasteners. One case, for example, has two relatively large sheets of adhesive pile fastening material along the sidewalls extending substantially the entire height of the sidewalls and a substantial portion of the width of them. The dividing walls are usually fabric covered foam, and each divider has the mating Velcro hook fastening material at each end so that the ends of the divider can be attached to the walls. One minor drawback with such a system is that a large quantity of Velcro fastening fabric is needed. There may also be secondary dividers running perpendicular to the first dividers to create compartments on both sides of the secondary divider. The vertical dividers create compartments for lenses and other accessories and a space for the camera.

To store the camera with the lens extending outward horizontally, it is frequently desirable to have an additional bottom, horizontal support for the camera which extends outward from the side and/or end walls. The top of the camera is then retained near the top of the case so that the camera is within easy reach. Also, the region below the horizontal camera support can be used for storing other accessories. In previous cases that stored a camera body with lens attached, the lens displaced other useful space in the case and rendered the space unusable.

One way of providing the divider for the camera body was to have a curved, vertical divider at the end of the case long enough so that the camera could fit between the end wall and the divider. Note that a large space is not otherwise usable in this arrangement. The divider is fastened to the sidewall, the end wall or the corner in a similar fashion to other vertical dividers. The horizontal divider is attached to the end wall by means of opposing Velcro fastening strips, one strip on the end wall and one strip on the end of the horizontal divider. One or more tabs of Velcro fabric are attached to the other end of the horizontal divider, and these tabs intersect Velcro fasteners on the inside face of the divider.

The horizontal divider has a fixed vertical position, which offers no flexibility. If the case is going to accommodate different camera bodies with different attachments, such as a power winder attached to the bottom of the camera body, a fixed divider will not allow adjustments. The previously mentioned Weinreb patent does have a trap door-like support that can pivot out of the way and allow the camera body to rest on the base of the camera bag, but it is not truly adjustable.

It is also desirable to allow the camera body to be stored in the case with one of various sized lenses attached to and extending horizontally from the camera body.

When the telephoto or other long lens is mounted on the camera, it is important to support the lens properly to minimize the torque on the camera body. Therefore, it is important to secure the telephoto lens from vertical and horizontal movement to the greatest extent possible.

SUMMARY OF THE INVENTION

The objects of the present invention are as follows. Primarily, the object of the present invention is to disclose and provide a case for holding equipment, especially photographic equipment, safely and with ease of accessibility of the parts. The invention supports various sized camera bodies with a telephoto or other lens attached. The present invention also allows for correct positioning of the camera body with an electric winder or another accessory attached to the bottom of the camera body. It is therefore an important object to support the camera with lens attached properly within the case and position the camera body properly so that both the bottom of the camera body and the lens are supported even though the height of the camera body or the position of the lens relative to the bottom of the camera body may change. When a long lens is mounted on the camera, the camera with lens attached may be carried in the case without displacing the space of additional accessories. The other objects in the case are also accessible and protected. Another object is to have the case readily capable of modification so that lenses and accessories of different sizes can be stored.

These objects and other objects that will be evident in the disclosure of the invention, are obtained by having the case include a pair of end walls connected between the ends of a pair of sidewalls. The sidewalls and end walls extend upward from a bottom wall to form a protective shell. There may also be a cover for the top of the case. The inside of the case is divided by at least one generally upright divider that extends between the sidewalls and separates the case into at least two compartments. The dividers are adjustably mounted so that by changing the dividers' positions, the number and size of the compartments is modified. A U-shaped cutout at the top of each divider receives a lens or other cylindrical object extending perpendicular to the dividers. A generally horizontal separator, which is also referred to as an elevator support, extends between the sidewalls and one of the end walls and provides a horizontal surface above the bottom wall for supporting the equipment. The elevator support is secured in an adjustable fashion so that its vertical location can be adjusted. The elevator support is positioned such that it supports the base of the camera while the U-shaped cutouts support the lens. The elevator support can also tilt somewhat to accommodate a projection extending down from one side of the bottom of the camera. As the distance between the bottom of the lens and the bottom of the base of the camera body increases, the elevator support is lowered so that the cutouts and the elevator support positions the camera and lens evenly.

In one embodiment, the dividers are adjusted by means of Velcro tabs that are made with complimentary Velcro strips running along the sidewalls. The dividers may also have vertical Velcro strips along their face to which smaller vertical dividers mounted perpendicularly to the first mentioned main dividers are mounted to divide each compartment in half. The elevator support ay also be mounted by Velcro strips. On the sides of the support, tabs extend upward to intersect and grip the Velcro strip on the sidewall, and another tab grips a Velcro strip on the end wall.

In another embodiment, the narrow Velcro strips attached to the sidewalls are replaced by a wider piece of Velcro, and the complimentary Velcro on the dividers is modified for gripping the larger piece on the sidewalls.

BRIEF DESCRIPTION OF THE DRAWINGS

Two sheets of drawings are presented.

FIG. 1 is a rear perspective view of one exemplary embodiment of the case of the present invention with the cover closed.

FIG. 2 is a side, sectional view of the same embodiment of the present invention taken through plane II—II in FIG. 1.

FIG. 3 is an end sectional view of the same embodiment of the present invention taken through plane III—III of FIG. 2.

FIG. 4 is an exploded view showing from right to left the horizontal separator/elevator support, the main divider and an intermediate divider of the same embodiment of the present invention.

FIG. 5 is a front perspective view, partially cut away of the second embodiment of the present invention.

FIG. 6 is a side, sectional view of the second embodiment of the present invention taken through plane VI—VI of FIG. 5.

DETAILED DESCRIPTION OF THE PREFERRED EMBODIMENTS

Figures 1, 2, 3, 4:
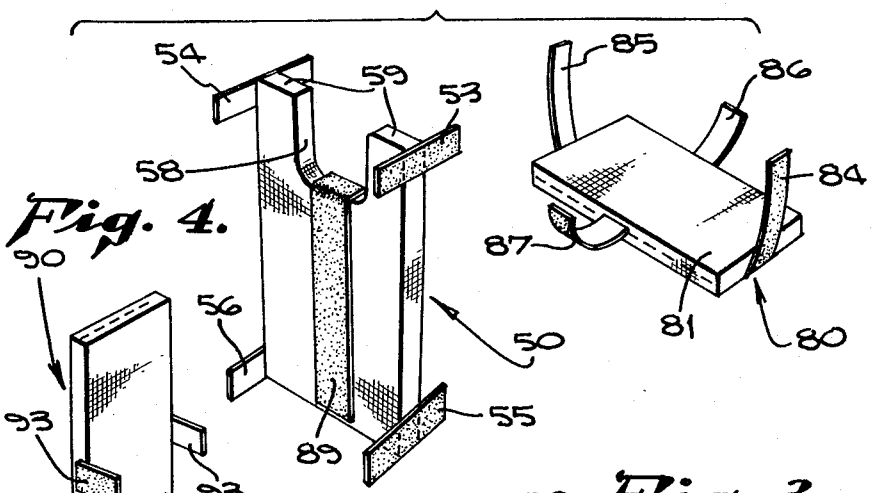
FIGS. 1–4 are on the first sheet.

The case 10 of the first exemplary embodiment of the present invention is shown in perspective in FIG. 1. Case 10 generally comprises a shell 11 which is formed from end walls 21 and 22 (FIG. 2) and sidewalls 31 and 32 (FIG. 3). The sidewalls and end walls extend upward from bottom wall 41 (FIGS. 2 and 3) and the shell may be covered by means of a cover 12. Sidewalls 31 and 32 are wider than end walls 21 and 22, but this could be modified is desired. The case may have pockets 13 and 14 mounted on each side for storing certain types of items, and there may be a front pocket 18 (FIG. 3) for storing other items. The pockets can expand considerably to hold much equipment. The ones shown in the exemplary embodiment of FIG. 1 are covered, but they may be open if desired. The cover may be fastened closed by suitable fastening means. A relatively flat pocket is shown at 20 along sidewall 31. Pocket 20 is open and is useful for carrying relatively flat items. The size, location and configuration of the pockets and their covers can be modified substantially.

Figure 5:
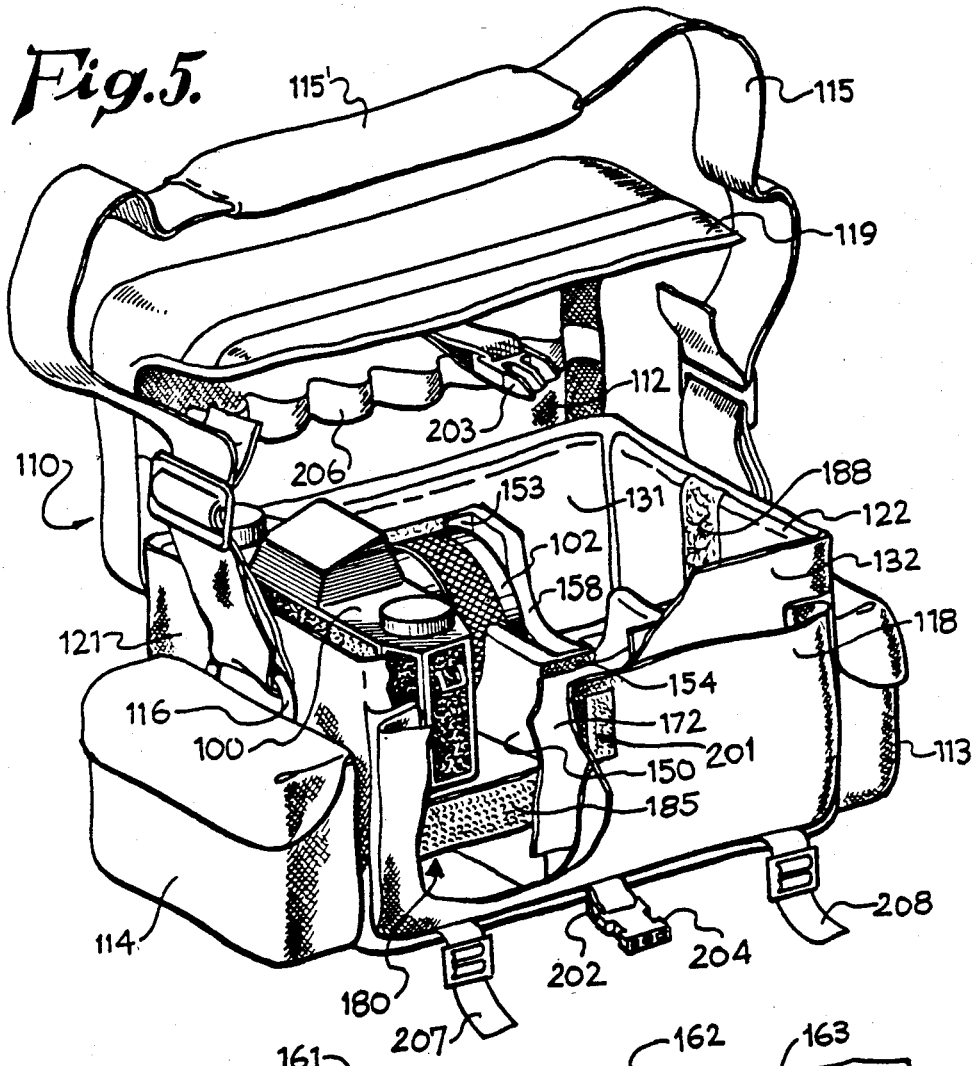
FIGS. 5 and 6 are on the second sheet.

Most of the differences between the two exemplary embodiments are internal and relate to the manner in which the various parts adjust. Although the outside appearance of case 110 in FIG. 5 is somewhat different than case 10 in FIG. 1, the outside shells are interchangeable. Pockets 113 and 114 are also of a slightly different shapes than the pockets in FIG. 1. Pocket 118 is open. A flap 119 on cover 112 closes pocket 118 and connects to Velcro fastener 201. Clips 203 and 204 may fasten belt 202 over cover 112, flap 119 and pocket 118.

In the first embodiment end walls 21 and 22, the sidewalls 31 and 32 and bottom wall 41 are each formed essentially of three pieces. Because the construction of the walls of the case in both embodiments is substantially similar, there will be no discussion of the construction of the walls as it relates to FIGS. 5 and 6.

Inner fabric 24 (FIG. 2) or 34 (FIG. 3) forms the inside face of end walls 21 and 22 and sidewalls 31 and 32, respectively. Likewise, bottom wall 41 is covered on top by inner fabric 44. As the inner fabric lines the inside of the case, it should be generally smooth and resistant to moisture and dirt. Nylon is used in the exemplary embodiment.

The inner fabric covers the inside sheets of foam plastic 25, 35 and 45. The material chosen must be rigid enough so that the case maintains its shape and yet flexible and shock absorbing to act as padding for protection of delicate camera equipment. The exemplary embodiment uses cross-linked polyethylene foam plastic. The foam pieces 25 in the end wall and the foam pieces 35 in the sidewalls may rest on or outside of the sheet of foam 45 of the bottom wall. Alternatively and as shown in the first exemplary embodiment (FIG. 2), a single, bent piece of foam forms the bottom and end walls. The rectangular shape of the foam sheets 35 of the sidewall maintain the portions of the foam sheet in end walls 21 and 22 upright.

The outside of the case is covered in tough, tear resistant fabric such as Cordura nylon or cotton duck, which is treated to make it water repellent. Referring to the drawings of the first exemplary embodiment, the end walls 21 and 22 are covered by outer fabric 26, the sidewalls 31 and 32 are covered by outer fabric 36, and the bottom wall is covered with the same outer fabric 46. Depending on the manufacturing method used, one piece of outer fabric could be used to cover two adjacent sides, and the outer fabric 26 for end walls 21 and 22 can be part of the same piece of fabric that is the outer fabric 46 on bottom wall 41 (FIG. 2).

The seams are sewn together, but they may be fastened by other types of fastening means. For protection, the seams may be covered by cording 28 (FIG. 2), which in the exemplary embodiment is a single piece of ribbing that covers the top of the end walls 21 and 22 and sidewalls 31 and 32. Cover 12 is also formed of a three piece sandwich of the outer fabric, an inner form plastic sheet and inner fabric. The plastic sheet adds rigidity to the cover and serves to offer more protection to the contents of the case. Part of the cover 12 extends over the front sidewall 32 as shown in FIG. 1. It may be fastened to sidewall 31 by means of snaps, Velcro fasteners, straps, a combination of the methods or by a zipper. End walls 121, 122, sidewalls 131 and 132, bottom wall 141 and cover 112 in the second embodiment are constructed similarly to the first embodiment.

A shoulder strap 15 is attached to the case by means of rings 16 on both ends of case 10 (FIG. 1). Rings 16 are in turn attached to strap 15' which preferably is sewn to the outside of end walls 21 and 22 and bottom wall 41. Although it is not necessary to have strap 15' extend along the bottom wall 41, the relatively thick nylon strap 15' adds additional strength for supporting the case. The position of rings 16 (FIG. 1) or 116 (FIG. 5) that attach shoulder strap 15 (115) to the case can be changed if desired. Strap 115 is shown extending through a shoulder pad 115' for added comfort.

In the preferred embodiments, each of the vertical seams where the end walls 21 and 22 (121, 122) intersect the respective sidewalls 31 and 32 (131, 132) are sewn along their edges such that the inner and outer fabrics are sewn together. The edges may be covered with cording (not shown) for protection. In sewing some of the edges, one side of a pocket may be simultaneously sewed. Although edges could be fastened by alternative means, sewing leaves strong, flexible seams.

Other attachments may be added to various parts of the case for the convenience of the user. An auxiliary handle (not shown) could be added to the cover if it were desired to carry the case without utilizing shoulder strap 15. In the first exemplary embodiment, however, there are two mounting members 17 (FIG. 1), preferably formed of vinyl or leather that are sewn into the top of cover 12. Short straps or belts can be looped through the slot in fittings 17 to secure other equipment that might be carried with the case such as a small tripod, monopod or flash umbrella. Additionally, loops of elastic material 206 (FIG. 5) may be fastened to the underside of cover 112, and film containers may be held in these loops. Straps 207 and 208 for holding a tripod may also be provided (FIG. 5).

At least one divider means extends between the sidewalls for dividing the case into at least two compartments. In the first exemplary embodiment, the divider 50 is shown in FIGS. 2, 3 and 4. As shown in FIG. 2, there are three intermediate dividers. The number used will change depending on the desired configuration and size of the case.

Each divider 50 is formed of a sandwich of an outer fabric 51 covering a central foam plastic panel 52 (FIG. 2). Normally, outer fabric 51 is formed as a pocket, the foam member 52 is inserted into an opening left in the pocket, and then the opening is closed by sewing the last seam. Outer fabric 51 is the same fabric used as inner fabric 24, 34 and 44 for the main walls for the same reasons the fabric is used in those applications, and the foam is also the same that is used in the end walls 21 and 22, the sidewalls 31 and 32 and the bottom wall 41.

As shown in FIG. 2, the three generally upright main dividers 50 create four compartments 61, 62, 63 and 64. The second embodiment uses two dividers, and the perspective view of FIG. 5 shows the compartmentalization. The number of dividers used is a matter of choice. In both embodiments, the dividers extend the entire distance between the sidewalls and are adjustably secured to the sidewalls. In the exemplary embodiments of FIGS. 1–4, dividers 50 are secured to sidewalls 31 and 32 by adjustable securing means on the sidewalls and on the dividers for adjusting the location of the dividers to change the size of compartments 61–64 (FIG. 2). Short, horizontal tabs 53, 54, 55 and 56 (FIG. 4) are sewn along the seam of the edge of divider 50. The tabs in the first exemplary embodiment have a Velcro surface consisting of the hook portion, although a wide variety of holding means could be provided. Elongated strips, 71, 72, 73 and 74 (all of which are shown in FIG. 3 and two of which are shown in FIG. 2) extend along generally the entire length of the sidewalls 31 and 32. These strips 71–74 have the complimentary Velcro loop pile that is gripped by the Velcro hooks on tabs 53–56 (FIG. 2). By positioning tabs 53–56 along the corresponding strips 71–74, the positions of dividers 50 can be changed, and the size of compartments 61–64 is modified. Strips 71 may be attached by adhesives to inner fabric 34, but it is preferred to sew the strips to inner fabric 34 before the inner fabric is formed into its sandwich to make sidewalls 31 and 32. If desired, an additional strip of backing fabric may be used behind strips 71–74 for strength in relationship to inner fabric 34.

Figure 6:
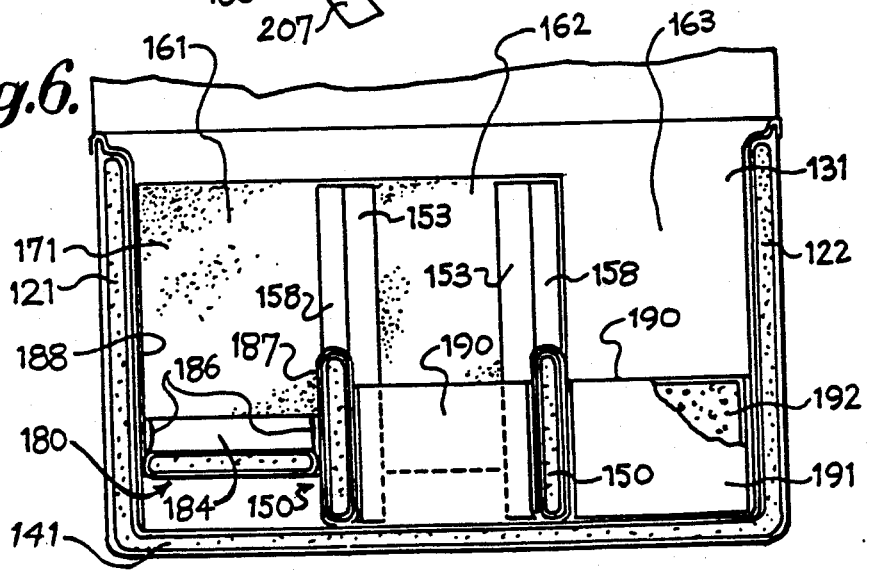

In the second exemplary embodiment, the short Velcro tabs 53–56 are replaced by narrow flaps 153 and 154 that bend about the side edges of dividers 150. The flaps have Velcro hook fasteners on one face, and by bending flaps 153 and 154 perpendicular to the remainder of dividers 150, the Velcro surface is against sidewalls 131 and 132. Likewise, the narrow Velcro strips, 71–74 of the first embodiment are replaced with two panels 171 (only one is visible) of Velcro loop fabric (FIG. 6). The panels extend over most of the entire sidewalls 131 and 132 in FIG. 6. The Velcro material on flaps 154 can engage the Velcro material of panel 171 to secure dividers 150 in place. Depending on ones needs, the various dividers can be positioned at any desired horizontal position along sidewalls 131 and 132. Upright dividers that are attached to the sidewalls are not new and the particular manner in which the dividers are secured and made adjustable in the second embodiment is similar to at least one prior art device.

The first embodiment utilizes substantially less Velcro at a cost savings. Moreover, most of the inside exposed surface of the first case is the relatively smooth, nylon inner fabric, which is substantially less susceptible to dirt than if large areas are covered in Velcro adhesive pile. The second embodiment does, however, offer some advantages. The larger panels 171 are easier to secure to the sidewalls, and the attaching system allows the dividers to be slightly more vertically adjustable. The case of the present invention also has a horizontal separator for providing a vertically adjustable, generally horizontally supporting surface above the bottom wall. In view of their vertical adjustability they are also referred to elevator supports. Depending on the position of the elevator support, a compartment may also be formed between the elevator support and the bottom of the case.

In the first exemplary embodiment, the horizontal separators 80 extend between sidewalls 31 and 32 and is preferably attached to one of the end walls 21 or 22. In FIG. 2, two horizontal separators 80 are shown, and each is attached to one of the end walls 21 and 22 in a manner described below.

In the first exemplary embodiment, the elevator support 80 FIGS. 2, 3 and 4) also divides compartment 61 into an upper compartment 65 and a lower compartment 66 (FIGS. 2 and 3). Another separator divides compartment 64 into two compartments in the same manner.

Horizontal separators 80 (and 180) are formed the same way that divider 50 is formed. Separator 80 uses the same foam plastic 82 (FIG. 2) that is in the walls and the divider and it is covered in the same fabric 81 (FIGS. 2 and 4) that covers the inside of the walls and the outside of the dividers.

The sides and end walls 21, 22, 31 and 32 and dividers 50 are subject to vertical loading and must be thick enough for some rigidity. On the other hand, horizontal separators 80 (and 180) will not loaded on end, so they may not have to be as rigid as the dividers, or the side and/or bottom walls. The foam can be somewhat thinner.

Adjustable attaching means on the elevator support and the sidewalls allow for adjustment of the vertical position of the support. As previously stated, an elevator support that must be at a fixed vertical position is a drawback because the camera body may have a different height.

The adjustable attaching means for the elevator support in the first embodiment includes Velcro tabs 84 and 85 (FIG. 4) containing the hook portion of the Velcro fastening material. As shown in FIGS. 2 and 3, tabs 84 and 85 extend upward from elevator support 80 and can grip strips 71 and 72 so that elevator support 80 hangs from strips 71 and 72. By adjusting which portion of the tabs 84 and 85 grip strips 71 and 72, the vertical position of horizontal elevator supports 80 is adjusted.

For additional support, there are also secondary tabs 86 and 87 which are similar to but somewhat shorter than tabs 84 and 85. Strip 88 of Velcro loop pile (FIG. 3) extends vertically along end wall 21 and 22, and the Velcro hook material of tab 87 grips strip 88 (FIG. 3 and left side of FIG. 2). Tab 87 also prevents support 80 from moving horizontally to create a space between the support and the end walls, which will allow items to fall through. An additional strip 89 (FIG. 3) of Velcro loop pile extends vertically upward at the center of each divider 50. One of the secondary tabs 86 or 87 grips strip 89 depending on the way elevator support 80 is turned Tabs 84–87 are sewn along the seams of the elevator support 80 (FIG. 4), vertical end wall strip 88 (FIG. 3) is sewn to the inner fabric 24 of end walls 21 and 22, and the divider strip 89 (FIG. 4) is sewn to the outer fabric 51 of the divider 50. The divider strip loops over the top of divider 50 in the exemplary embodiments for ease of manufacture.

The elevator support 180 in the second exemplary embodiment may be the same as elevator support 80 in the first embodiment. In the second embodiment, the main tabs are replaced by short flaps 184, 185 (FIGS. 5 and 6) which are similar to flaps 153, 154. Flaps 184, 185 can be narrow and still be adjustable vertically along Velcro panels 171, 172 because the panels extend almost the entire height of the sidewalls 131, 132. Flaps 184, 185 can be narrow and still be adjustable vertically along the velcro panels 171, 172. The secondary tabs 186 are similar to and attach in the same way to Velcro strips 187, 188 as tabs 86 and 87 attached to Velcro strips 88, 89 in the first embodiment.

The support function of the elevator support is shown in FIG. 5. Support 180 is at one end of case 110. Camera body 100 is mounted on its bottom. The distance between the bottom of lens 102 and the bottom of its body 100 may change if, for example, an electric winder is attached to the bottom of body 100. If the horizontal separators 80 or 180 support a camera body 100 at the proper vertical height such that lens 102 is resting in U-shaped openings 58 or 158 of dividers 50 or 150, the elevator supports must be vertically adjustable.

If the bottom of the camera body has a projection on one side or is otherwise not flat or horizontal, elevator support 80 or 180 may be attached in a non-horizontal attitude.

Prior art cases could not accommodate a camera with a long lens attached. In one case, a horizontal separator of a relatively large size was provided, and a 35 mm camera with a normal lens attached would fit on the horizontal separator. If a telephoto or zoom lens were used, however, it would have to be removed because the divider blocked the lens. The U-shaped cutout portions 58 (FIGS. 3 and 4) or 158 (FIG. 5) accommodate the lenses as FIG. 5 shows. They extend downward far enough to accommodate the lens 102 without having the top of camera body 100 extend upward too high (FIG. 5).

Cutout 58 or 158 should have dimensions to accommodate the diameter of the largest lenses that the user is expected to carry attached to the camera body. The legs 59 (FIG. 4) of divider 50 are not too rigid; they can spread apart somewhat to accommodate wider diameter lenses. The sides of cutout 58 and 158 protect lenses from horizontal movement, and they also support the lens vertically.

Secondary dividers 90 divide the compartments in half. In the exemplary embodiments (FIGS. 2 and 6), two secondary dividers 90 (190) divide compartments 62 and 63 (162 and 163); no secondary divider is used in compartments 61, 64 and 161 where there is a elevator support. The width of the end wall must be wide enough to accommodate a camera body, which is usually at least twice the diameter of typical lenses. The secondary divider, therefore, allows each compartment to hold two lenses without each lens touching each other. The secondary divider is similar in construction to elevator support 80 (180) or divider 50 (150). It is a sandwich of the same inner fabric 91 (191) used for other applications covering an inner foam member 92 (192) (FIGS. 2 and 6 respectively). Because secondary divider 90 (190) will not be subject to compressive loads, the foam 92 (192) can be as thin as the foam for elevator support 80 (180). Velcro tabs 93 (FIG. 4) are sewn along the seams at the edge of secondary divider 90. Tabs 93 grip the Velcro adhesive pile on divider strips 89 on adjacent dividers 50. The horizontal position can be adjusted by modifying the positioning of the tabs 93 on divider strip 89, and vertical positioning is likewise possible if it is desired to leave a space for thin, wide objects along the bottom of the case. The tabs are replaced in the second embodiment by narrow flaps (not visible in the drawings) similar to flaps 153, 154.

The case of FIGS. 5 and 6 only carries one camera; only a single elevator support is provided. The Velcro panels 171, 172 on sidewalls 131, 132 (FIG. 6) terminate about one third of the way to one of the end walls because the additional Velcro is not needed. Typically, it would terminate slightly to the right (FIG. 6) of the right-most divider 150 beyond the maximum distance that flap 153 might extend when the divider is in its anticipated right-most position.

The second embodiment could be lengthened to hold two camera bodies. Each camera body would have an attached lens that would point toward each other. Velcro strips 171, 172 would extend the entire width of sidewalls 131, 132 to support a second elevator support.

Thus, a case meeting the objects previously set forth has been disclosed. Although an exemplary embodiment was taught, various modifications may be made to it by those skilled in the art that would still come within the scope and spirit of the present invention, which is limited only as defined in the claims.

I claim:

1. A camera bag for holding photographic equipment, and particularly adapted for containing and supporting a camera which has a body and which has a generally cylindrical lens protruding laterally from the body and which may or may not also have an automatic film winder attached below the body, such film winders having nonstandardized heights, so that the supportable undersurface of such camera is in effect a variable distance below such lens; said camera bag comprising:

four substantially vertical walls defining an internal compartment of generally rectangular plan, open at the top;

a substantially vertical transverse partition secured across the width of the compartment near one end wall thereof, and a cutout defined in the top of the partition for closely receiving and supporting such a protruding lens so that such lens may be lifted vertically out of the cutout and removed with such camera through the open top of the compartment; and means for firmly but adjustably supporting such a camera body immediately adjacent to the partition in such a way that the centerline of such lens is substantially horizontal regardless of whether there is or is not such an automatic winder attached below such camera body and regardless of the height of such an automatic winder; said supporting means being adapted to permit such lens to be lifted vertically out of the cutout, and to permit such camera and lens to be removed together through the open top of the compartment.

2. The camera bag of claim 1 wherein:

the firm but adjustable supporting means support such camera at an adjustable distance below the cutout to compensate for such variable distance of such supportable undersurface below such lens.

3. The camera bag of claim 1 wherein:

the vertical partition forms with the one end wall, and with the nearest portions of the two exterior walls that intersect that end wall, a subcompartment;

the subcompartment having four subcompartment walls, namely: the one end wall, the side of the vertical partition facing that end wall, and the portions of the said two exterior walls that are between that end wall and the vertical partition; and the firm but adjustable supporting means comprise means for distributing the weight of such a camera body stablely and substantially equally over all four subcompartment walls.

4. The camera bag of claim 3 for use with such a camera whose body is of very generally rectangular plan, and wherein:

the firm but adjustable camera-supporting means comprise a substantially horizontal panel having generally rectangular plan that is sized to closely accommodate the plan dimensions of such a camera; and the weight-distributing means comprise means for adjustably securing the horizontal panel to all four subcompartment walls.

5. The camera bag of claim 4, wherein the weight-distributing means comprise:

hook-and-loop-type fastener means secured to the horizontal panel and facing toward the four subcompartment walls near the edge of the horizontal panel; and mating hook-and-loop-type fastener means disposed vertically along all four subcompartment walls facing toward the horizontal panel.

6. The camera bag of claim 1 particularly for use in holding photographic equipment that includes other photographic lenses in addition to the lens protruding from the camera body, and wherein:

the walls are closed at the bottom by a substantially common floor;

the cutout is spaced vertically above the floor far enough to permit storage of such other photographic lenses below the cutout and below such a lens protruding from such camera body; and such protruding lens may be repetitively lifted vertically out of the cutout and removed with such camera, and repetitively replaced in the cutout while still protruding from such camera body, without moving or disturbing such other lenses;

but such other lenses are immediately accessible to attach to such camera in substitution for such protruding lens.

7. The camera bag of claim 1, particularly for use in supporting a camera body from which the protruding lens is substantially longer than a normal-angle lens, and also comprising:

a substantially common floor closing the four walls at the bottom; and a substantially vertical longitudinal partition secured in the compartment adjacent to the transverse partition and separated from the camera-body supporting means by the transverse partition, the top of the longitudinal partition being at generally the same height above the floor as the cutout; and wherein such protruding lens is supported adjacent to the camera body by the cutout and is also supported remote from the camera body by the longitudinal partition.

8. The camera bag of claim 1, particularly for use in supporting a camera from which the protruding lens is substantially longer than a normal-angle lens, and also comprising:

a substantially common floor closing the four walls at the bottom;

a second substantially vertical transverse partition secured across the width of the compartment at a horizontal distance from the first-mentioned transverse partition, the second partition and the camera-body supporting means being at opposite sides of the first-mentioned partition; and a second cutout, defined in the top of the second partition, that is at substantially the same height above the floor as the cutout in the top of the first-mentioned partition; and wherein such protruding lens is supported adjacent to the camera body by the first-mentioned cutout and, if such protruding lens is substantially longer than said horizontal distance, is also supported remote from the camera body by the second cutout.

9. The camera bag of claim 1, particularly for use in supporting a camera from which the protruding lens is substantially longer than a normal-angle lens, and also comprising:

a substantially common floor closing the four walls at the bottom;

a substantially vertical longitudinal partition secured in the compartment adjacent to the transverse partition and separated from the camera-body supporting means by the transverse partition, the top of the longitudinal partition being at generally the same height above the floor as the cutout;

a second substantially vertical transverse partition secured across the width of the compartment at a horizontal distance from the first-mentioned transverse partition, and separated from the first-mentioned transverse partition by the longitudinal partition; and a second cutout, defined in the top of the second partition, that is at substantially the same height above the floor as the first-mentioned cutout in the top of the first-mentioned partition; and wherein such protruding lens is supported adjacent to the camera body by the first-mentioned cutout and is also supported remote from the camera body by the longitudinal partition; and, if such protruding lens is substantially longer than said horizontal distance, such protruding lens is also supported remote from the camera body by the second cutout.

10. The camera bag of claim 1, further comprising:

a second substantially vertical transverse partition secured across the width of the compartment near a second end wall thereof, and a second cutout defined in the top of the second partition for closely receiving and supporting a second such protruding lens so that such second protruding lens may be lifted vertically out of the second cutout and removed with a second such camera through the open top of the compartment; and second means for firmly but adjustably supporting such second camera body immediately adjacent to the second partition in such a way that the centerline of such second protruding lens is substantially horizontal regardless of whether there is or is not such an automatic winder attached below such second camera body and regardless of the height of such an automatic winder; said second supporting means being adapted to permit such second protruding lens to be lifted vertically out of the second cutout, and to permit such second camera and second protruding lens to be removed together through the open top of the compartment independently of such first-mentioned camera and first-mentioned protruding lens;

wherein two different such cameras with different such protruding lenses may be positioned facing toward one another at two opposed ends of the rectangular compartment, each such camera being independently stablely supported with its respective such protruding lens substantially horizontal, even if such two different cameras differ with respect to the presence of such an automatic winder, and even if such two different cameras differ with respect to the height of such an automatic winder if present.

11. The camera bag of claim 10, particularly for use in holding photographic equipment that includes other photographic lenses in addition to the lenses protruding from the camera bodies, and wherein:

the walls are closed at the bottom by a substantially common floor;

the cutouts are both spaced vertically above the floor far enough to permit storage of such other photographic lenses below the cutouts and below such protruding lenses; and such protruding lenses may be repetitively lifted vertically out of the respective cutouts and removed with such respective cameras, and repetitively replaced in the respective cutouts while still protruding from such respective camera bodies, without moving or disturbing such other lenses; but such other lenses are immediately accessible to attach to either of such cameras in substitution for either of such respective protruding lenses.

12. The camera bag of claim 1, further comprising:

a cover, secured to the compartment and adapted to be positioned to span and enclose the top of the compartment, for restraining and protecting such photographic equipment when such equipment is within the compartment.

13. A camera bag for holding photographic equipment, and particularly adapted for containing and supporting a camera which has a body and which has a lens protruding laterally from the body and which may or may not also have an automatic film winder of nonstandardized height attached below the body, so that the effective supportable undersurface of such camera is a variable distance below such lens; said camera bag comprising:

a generally rectangular base;

a pair of end walls connected at their ends to a pair of side walls, the side and end walls extending upward from the base to form an enclosure that is open at the top;

at least one generally upright main divider extending between the side walls, and a cutout defined in the top of the divider for closely supporting such lens in such a position that such lens may be lifted vertically out of the cutout and removed with such camera through the open top of the enclosure; the divider forming with one end wall and portions of the side walls a compartment having at least four wall surfaces in a generally rectangular arrangement;

at least one generally horizontal panel immediately adjacent the divider and spanning substantially the entire distance between the divider and the one end wall, providing a generally horizontal support surface above the base; and adjustable attaching means for depending the horizontal panel from at least two mutually opposed wall surfaces, of the four wall surfaces, to support such effective supportable undersurface of such camera at a variable distance below the cutout to compensate for such variable distance of such supportable undersurface below such lens so that the centerline of such lens is substantially horizontal; the horizontal panel and attaching means being adapted to permit such lens to be lifted vertically out of the cutout, and to permit such camera and lens to be removed together through the open top of the enclosure.

14. The camera bag of claim 13 wherein:

the adjustable attaching means distribute the weight of such camera body stabely and substantially equally over the divider, the one end wall and both side walls.

15. The camera bag of claim 13, particularly for use in holding photographic equipment that includes other photographic lenses in addition to the lens protruding from the camera body, and wherein:

the cutout is spaced vertically above the base far enough to permit storage of such other photographic lenses below the cutout and below such a lens protruding from such camera body; and such protruding lens may be repetitively lifted vertically out of the cutout and removed with such camera, and repetitively replaced in the cutout while still protruding from such camera body, without moving or disturbing such other lenses; but such other lenses are immediately accessible to attach to such camera in substitution for such protruding lens.

16. The camera bag of claim 13, particularly for use in supporting a camera body from which the protruding lens is substantially longer than a normal-angle lens, and also comprising:

a generally upright longitudinal divider secured in the enclosure adjacent to and perpendicular to the main divider and separated from the horizontal panel by the main divider, the top of the longitudinal divider being at generally the same height above the base as the cutout; and wherein such protruding lens is supported adjacent to the camera body by the cutout and is also supported remote from the camera body by the longitudinal divider.

17. The camera bag of claim 13, particularly for use in supporting a camera from which the protruding lens is substantially longer than a normal-angle lens, and also comprising:

a second generally upright main divider extending between the sidewalls at a horizontal distance from the first-mentioned main divider, the second main divider and the horizontal panel being at opposite sides of the first-mentioned main divider; and a second cutout, defined in the top of the second main divider, that is at substantially the same height above the base as the first-mentioned cutout in the top of the first-mentioned main divider; and wherein such protruding lens is supported adjacent to the camera body by the first-mentioned cutout and, if such protruding lens is substantially longer than said horizontal distance, is also supported remote from the camera body by the second cutout.

18. The camera bag of claim 13, particularly for use in supporting a camera from which the protruding lens is substantially longer than a normal-angle lens, and also comprising:

a generally upright longitudinal divider secured in the enclosure adjacent to the main divider and separated from the horizontal panel by the main divider, the top of the longitudinal divider being at generally the same height above the base as the cutout;

a second generally upright main divider extending between the sidewalls at a horizontal distance from the first-mentioned main divider, and separated from the first-mentioned main divider by the longitudinal divider; and a second cutout, defined in the top of the second main divider, that is at substantially the same height above the base as the first-mentioned cutout in the top of the first-mentioned main divider; and wherein such protruding lens is supported adjacent to the camera body by the first-mentioned cutout and is also supported remote from the camera body by the longitudinal divider; and, if such protruding lens is substantially longer than said horizontal distance, such protruding lens is also supported remote from the camera body by the second cutout.

19. The camera bag of claim 13, further comprising:

a second generally upright main divider extending between the sidewalls, and a second cutout defined in the top of the second main divider for closely supporting a second such protruding lens so that such second protruding lens may be lifted vertically out of the second cutout and removed with a second such camera through the open top of the enclosure; the second main divider forming with a second end wall and portions of the side walls a second compartment having opposed wall surfaces; and a second generally horizontal panel, immediately adjacent to the second divider and spanning substantially the entire distance between the divider and the second end wall, providing a second generally horizontal support surface above the base; and second adjustable attaching means for depending the second horizontal panel from at least two mutually opposed wall surfaces, of the second compartment, to support such effective supportable undersurface of a second such camera at a second variable distance below the second cutout to compensate for such variable distance of such second-camera supportable undersurface below such lens of such second camera so that the centerline of such second-camera lens is substantially horizontal; the second horizontal panel and second attaching means being adapted to permit such second protruding lens to be lifted vertically out of the second cutout, and to permit such second camera and second protruding lens to be removed together through the open top of the enclosure independently of such first-mentioned camera and first-mentioned protruding lens;

wherein two different such cameras with different such protruding lenses may be positioned facing toward one another at two opposed ends of the enclosure, each such camera being independently stablely supported with its respective such protruding lens substantially horizontal, even if such two different cameras differ with respect to the presence of such an automatic winder, and even if such two different cameras differ with respect to the height of such an automatic winder if present.

20. The camera bag of claim 19, particularly for use in holding photographic equipment that includes other photographic lenses in addition to the lenses protruding from the camera bodies, and wherein:

the cutouts are both spaced vertically above the base far enough to permit storage of such other photographic lenses below the cutouts and below such protruding lenses; and such protruding lenses may be repetitively lifted vertically out of the respective cutouts and removed with such respective cameras, and repetitively replaced in the respective cutouts while still protruding from such respective camera bodies, without moving or disturbing such other lenses; but such other lenses are immediately accessible to attach to either of such cameras in substitution for either of such respective protruding lenses.

21. The camera bag of claim 20, particularly for use in supporting at least one camera from which the protruding lens is substantially longer than a normal-angle lens, and also comprising:

a third generally upright main divider extending between the sidewalls and disposed between the first-mentioned main divider and the second main divider, and at a first horizontal distance from the first-mentioned main divider, and at a second horizontal distance from the second main divider; and a third cutout, defined in the top of the third main divider, that is at substantially the same height above the base as the cutouts in the tops of the first-mentioned main divider and the second main divider; and wherein such two different protruding lenses are supported adjacent to the respective camera bodies by the first-mentioned cutout and second cutout, respectively; and, if either such protruding lens is substantially longer than the first or second horizontal distance, respectively, then that particular protruding lens is also supported remote from the camera body by the third cutout.

22. The camera bag of claim 21, further comprising:

a first longitudinal divider secured in the enclosure between the first-mentioned main divider and the third main divider, and separated from the first-mentioned horizontal panel by the first-mentioned main divider;

a second longitudinal divider secured in the enclosure between the second main divider and the third main divider, and separated from the second horizontal panel by the second main divider;

the tops of the two longitudinal dividers being at generally the same height above the base as the three cutouts; and wherein either such protruding lens is further supported by at least one of the longitudinal dividers.

23. The camera bag of claim 13 further comprising:

a cover, secured to the enclosure and adapted to be positioned to span and enclose the top of the enclosure, for restraining and protecting such photographic equipment when such equipment is within the enclosure.

24. A camera bag for holding photographic equipment, and particularly adapted for containing and supporting a camera that has a body and that has attached to and protruding laterally from the body a lens which is substantially longer than a normal-angle lens, and also particularly adapted for storage of a plurality of other lenses that are substitutable for the protruding lens on the camera; said camera bag comprising:

a generally rectangular base;

a pair of end walls connected at their ends to a pair of side walls, the side and end walls extending upward from the base to form an enclosure;

at least two generally upright and generally parallel but spaced-apart main dividers extending between the side walls and spaced from the end walls;

a cutout defined in the top of each divider for closely receiving and supporting such protruding lens while such lens is attached to such camera body;

both cutouts being spaced vertically above the base far enough to permit storage of such other photographic lenses below the cutouts and, when such protruding lens is received in the cutouts, below such protruding lens; and at least one generally upright longitudinal divider extending between the main dividers for organizing and confining such other lenses below such protruding lens;

the top of the longitudinal divider being generally at the same height above the base as the cutouts; and wherein, when the protruding lens is received in the cutouts, the top of the longitudinal divider aids in supporting the protruding lens.

25. The camera bag of claim 24, further comprising:

a cover, secured to the enclosure and adapted to be positioned to span and enclose the top of the enclosure, for restraining and protecting such photographic equipment when such equipment is within the enclosure.

* * * * *